US009361827B2

(12) United States Patent
Qian

(10) Patent No.: US 9,361,827 B2
(45) Date of Patent: Jun. 7, 2016

(54) ORGANIC LIGHT EMITTING DIODE PIXEL COMPENSATION CIRCUIT, DISPLAY PANEL AND DISPLAY DEVICE

(71) Applicants: Shanghai Tianma AM-OLED Co., Ltd., Shanghai (CN); Tianma Micro-Electronics Co., Ltd., Shenzhen (CN)

(72) Inventor: Dong Qian, Shanghai (CN)

(73) Assignees: Shanghai Tianma AM-OLED Co., Ltd., Shanghai (CN); Tianma Micro-Electronics Co., Ltd., Shenzhen (CN)

( * ) Notice: Subject to any disclaimer, the term of this patent is extended or adjusted under 35 U.S.C. 154(b) by 0 days.

(21) Appl. No.: 14/470,766

(22) Filed: Aug. 27, 2014

(65) Prior Publication Data

US 2015/0356916 A1 Dec. 10, 2015

(30) Foreign Application Priority Data

Jun. 5, 2014 (CN) ..... 2014 1 0247291

(51) Int. Cl.
*G09G 3/32* (2006.01)

(52) U.S. Cl.
CPC ..... *G09G 3/3233* (2013.01); *G09G 2300/0814* (2013.01); *G09G 2300/0819* (2013.01); *G09G 2300/0876* (2013.01); *G09G 2320/0233* (2013.01)

(58) Field of Classification Search
CPC ..... G09G 3/30; G09G 3/32; G09G 3/3208
USPC ..... 345/78, 204
See application file for complete search history.

(56) References Cited

U.S. PATENT DOCUMENTS

2011/0134100 A1* 6/2011 Chung ..... G09G 3/325 345/76
2011/0157126 A1 6/2011 Chung et al.

FOREIGN PATENT DOCUMENTS

CN 101859536 A 10/2010
CN 102194405 A 9/2011
CN 102708785 A 10/2012

(Continued)

OTHER PUBLICATIONS

Office Action as issued in corresponding German Application 102014112933.4, dated May 11, 2015.

(Continued)

*Primary Examiner* — Carolyn R Edwards
(74) *Attorney, Agent, or Firm* — Alston & Bird LLP

(57) ABSTRACT

An organic light emitting diode pixel compensation circuit is disclosed. The compensation circuit compensates threshold voltage of a TFT and supply voltage in a pixel circuit to address non-uniform in a display. In the circuit, a first transistor transmits a data signal to a first capacitor based on a scan signal; a second transistor transmits a reference signal to the first capacitor based on a first light emission signal; a third transistor connects a gate of a drive transistor with a drain of the drive transistor based on the scan signal to read the difference between supply voltage and threshold voltage of the drive transistor and to transmit the difference to the first capacitor and a second capacitor; and the drive transistor generates the drive current based on the supply voltage and the voltage on the first capacitor to drive an organic light emitting diode emit light.

10 Claims, 4 Drawing Sheets

(56) References Cited

FOREIGN PATENT DOCUMENTS

| | | | |
|---|---|---|---|
| CN | 103927975 | A | 7/2014 |
| EP | 1939594 | A2 | 12/2007 |

OTHER PUBLICATIONS

Office Action as issued in corresponding Chinese Application No. 201410247291.4, dated Oct. 10, 2015.

* cited by examiner

ORGANIC LIGHT EMITTING DIODE PIXEL COMPENSATION CIRCUIT, DISPLAY PANEL AND DISPLAY DEVICE

CROSS-REFERENCES TO RELATED APPLICATIONS

This application claims the benefit of Chinese Patent Application No. 201410241.4, filed with the Chinese Patent Office on Jun. 5, 2014 and entitled "ORGANIC LIGHT EMITTING DIODE PIXEL COMPENSATION CIRCUIT, DISPLAY PANEL AND DISPLAY DEVICE", which is hereby incorporated by reference in its entirety.

TECHNICAL FIELD

The present application relates to the field of display technologies and particularly to an organic light emitting diode pixel compensation circuit, a display panel and a display device.

BACKGROUND OF THE INVENTION

An Active Matrix Organic Light Emitting Diode (AMOLED) display has been widely applied due to its wide angle of view, good color contrast effect, high response speed, low cost and other advantages. However a drift in threshold voltage and the consequential non-uniformity ire the display of the entire image may occur due to the problems of non-uniformity and instability of a Thin Film Transistor (TFT) back panel in a process flow.

Moreover the number of transmission lines of power supplies to power respective pixel circuits has been constantly increasing with the increasingly larger sizes of AMOLEDs, so that there may be more serious attenuation of voltage across a transmission line of a power supply for an AMOLED larger in size, thus degrading the non-uniformity of display.

BRIEF SUMMARY OF THE INVENTION

One inventive aspect is all organic light emitting diode pixel compensation circuit configured to drive an organic light emitting diode to emit light. The organic light emitting diode pixel compensation circuit includes a first transistor, a second transistor, a third transistor, a fourth transistor, a first capacitor, a second capacitor, and a drive transistor. The first transistor is configured to transmit a data signal to a first pole of the first capacitor based on a scan signal, the second transistor is configured to transmit a reference signal to the first pole of the first capacitor based on a first light emission signal, and the third transistor is configured to connect a gate of the drive transistor with a drain of the drive transistor based on the scan signal to read the difference between supply voltage and threshold voltage of the drive transistor, and to transmit the difference to a second pole of the first capacitor and to a first pole of the second capacitor. The fourth transistor is configured to provide the organic light emitting diode with drive current generated by the drive transistor based on a second light emission signal, the first capacitor is configured to store the received voltage and to couple a voltage value based on the change in voltage on the first pole of the first capacitor onto the second pole of the first capacitor, and the second capacitor is configured to receive the supply voltage at a second pole of the second capacitor. The drive transistor is configured to generate the drive current based on the supply voltage and the voltage on the second pole of the first capacitor, and the organic light emitting diode is configured to emit light corresponding to the drive current generated by the drive transistor.

Another inventive aspect is an organic light emitting diode pixel compensation circuit. The circuit includes a first transistor including a gate to which a scan signal is applied, and a first pole to which a data signal is applied, a second transistor including a gate to which a first light emission signal is applied, and first pole to which a reference signal is applied, and a third transistor including a gate to which the scan signal is applied. The circuit also includes a fourth transistor including a gate to which a second light emission signal is applied, a first capacitor including a first pole connected with a second pole of the first transistor and a second pole of the second transistor, and a second pole connected with a first pole of the third transistor, and a second capacitor including a first pole connected with the first pole of the third transistor and a second pole at which a supply voltage is received. The circuit also includes an organic light emitting diode including a cathode at which a low level signal is received, and an anode connected with a first pole of the fourth transistor, and a drive transistor including a gate connected with the second pole of the first capacitor and with the first pole of the second capacitor, a source to which the supply voltage is applied, and a drain connected with a second pole of the third transistor and a second pole of the fourth transistor.

Another inventive aspect is a display panel, including an organic light emitting diode pixel compensation circuit. The circuit includes first transistor including a gate to which a scan signal is applied, and a first pole to which a data signal is applied, a second transistor including a gate to which a first light emission signal is applied, and a first pole to which a reference signal is applied, and a third transistor including a gate to which the scan signal is applied. The circuit also includes a fourth transistor including a gate to which a second light emission signal is applied, a first capacitor including a first pole connected with a second pole of the first transistor and a second pole of the second transistor, and a second pole connected with a first pole of the third transistor, and a second capacitor including a first pole connected with the first pole of the third transistor and a second pole at which a supply voltage is received. The circuit also includes an organic light emitting diode including a cathode at which a low level signal is received, and an anode connected with a first pole of the fourth transistor, and a drive transistor including a gate connected with the second pole of the first capacitor and with the first pole of the second capacitor, a source to which the supply voltage is applied, and a drain connected with a second pole of the third transistor and a second pole of the fourth transistor.

Another inventive aspect is a display panel, including an organic light emitting diode pixel compensation circuit. The organic light emitting diode pixel compensation circuit includes a first transistor, a second transistor, a third transistor, a fourth transistor, a first capacitor, a second capacitor, and a drive transistor. The first transistor is configured to transmit a data signal to a first pole of the first capacitor based on a scan signal, the second transistor is configured to transmit a reference signal to the first pole of the first capacitor based on a first light emission signal, and the third transistor is configured to connect a gate of the drive transistor with a drain of the drive transistor based on the scan signal to read the difference between supply voltage and threshold voltage of the drive transistor, and to transmit the difference to a second pole of the first capacitor and to a first pole of the second capacitor. The fourth transistor is configured to provide the organic light emitting diode with drive current generated by the drive transistor based on a second light emission signal, the first capacitor is configured to store the received voltage and to couple a voltage value based on the change in voltage on the first pole of the first capacitor onto the second pole of the first capacitor, and the second capacitor is configured to receive the supply voltage at a second pole of the second capacitor. The drive transistor is configured to generate the drive current based on the supply voltage and the voltage on the second pole of the first capacitor, and the organic light emitting diode is configured to emit light corresponding to the drive current generated by the drive transistor.

Another inventive aspect is a display device, including an organic light emitting diode pixel compensation circuit. The circuit includes a first transistor including a gate to which a scan signal is applied, and a first pole to which a data signal is applied, a second transistor including a gate to which a first light emission signal is applied, and a first pole to which a reference signal is applied, and a third transistor including a gate to which the scan signal is applied. The circuit also includes a fourth transistor including a gate to which a second light emission signal is applied, a first capacitor including a first pole connected with a second pole of the first transistor and a second pole of the second transistor, and a second pole connected with a first pole of the third transistor, and a second capacitor including a first pole connected with the first pole of the third transistor and a second pole at which a supply voltage is received. The circuit also includes an organic light emitting diode including a cathode at which a low level signal is received, and an anode connected with a first pole of the fourth transistor, and a drive transistor including a gate connected with the second pole of the first capacitor and with the first pole of the second capacitor, a source to which the supply voltage is applied, and a drain connected with a second pole of the third transistor and a second pole of the fourth transistor.

Another inventive aspect is a display device, including an organic light emitting diode pixel compensation circuit. The organic light emitting diode pixel compensation circuit includes a first transistor, a second transistor, a third transistor, a fourth transistor, a first capacitor, a second capacitor, and a drive transistor. The first transistor is configured to transmit a data signal to a first pole of the first capacitor based on a scan signal, the second transistor is configured to transmit a reference signal to the first pole of the first capacitor based on a first light emission signal, and the third transistor is configured to connect a gate of the drive transistor with a drain of the drive transistor based on the scan signal to read the difference between supply voltage and threshold voltage of the drive transistor, and to transmit the difference to a second pole of the first capacitor and to a first pole of the second capacitor. The fourth transistor is configured to provide the organic light emitting diode with drive current generated by the drive transistor based on a second light emission signal, the first capacitor is configured to store the received voltage and to couple a voltage value based on the change in voltage on the first pole of the first capacitor onto the second pole of the first capacitor, and the second capacitor is configured to receive the supply voltage at a second pole of the second capacitor. The drive transistor is configured to generate the drive current based on the supply voltage and the voltage on the second pole of the first capacitor, and the organic light emitting diode is configured to emit light corresponding to the drive current generated by the drive transistor.

DETAILED DESCRIPTION OF THE PREFERRED EMBODIMENTS

With an organic light emitting diode pixel compensation circuit, a display panel and a display device according to embodiments of the application, such control is performed by a scan signal so that a gate of a drive transistor can be connected with a drain of the drive transistor through a third transistor to read the difference between supply voltage and threshold voltage of the drive transistor and to store the difference at a second pole of a first capacitor and a first pole of a second capacitor, thereby eliminating an influence of the supply voltage and the threshold voltage of the drive transistor upon generation of drive current by the drive transistor from the supply voltage and voltage on the second pole of the first capacitor so as to make the generated drive current independent from the supply voltage and the threshold voltage of the drive transistor, which can address such a problem that the non-uniformity in the display of the entire image on the display panel from may occur because OLEDs in different areas are driven by different current upon reception of the same image data signal to emit light as a result of a drift in threshold voltage of the drive transistor and of the varying supply voltage received at pixels in the different areas due to varying resistance across a transmission line of the display panel.

Particular implementations of the organic light emitting diode pixel compensation circuit, the display panel and the display device according to the embodiments of the application will be described below with reference to the drawings.

Figure 1:
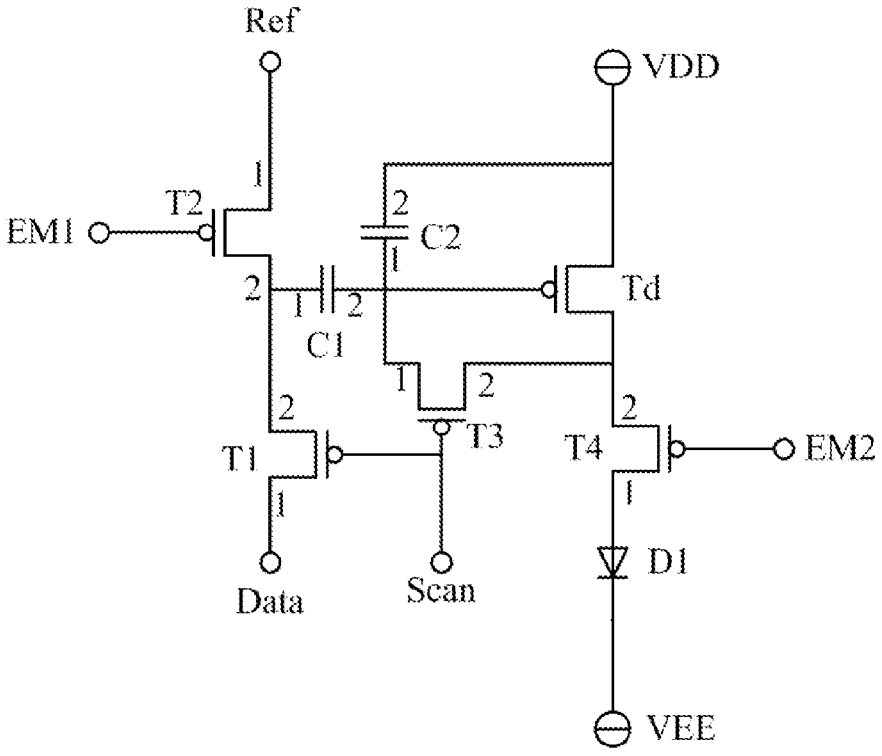
FIG. 1 is a circuit diagram of an organic light emitting diode pixel compensation circuit according to an embodiment of the application.
Figure 4:
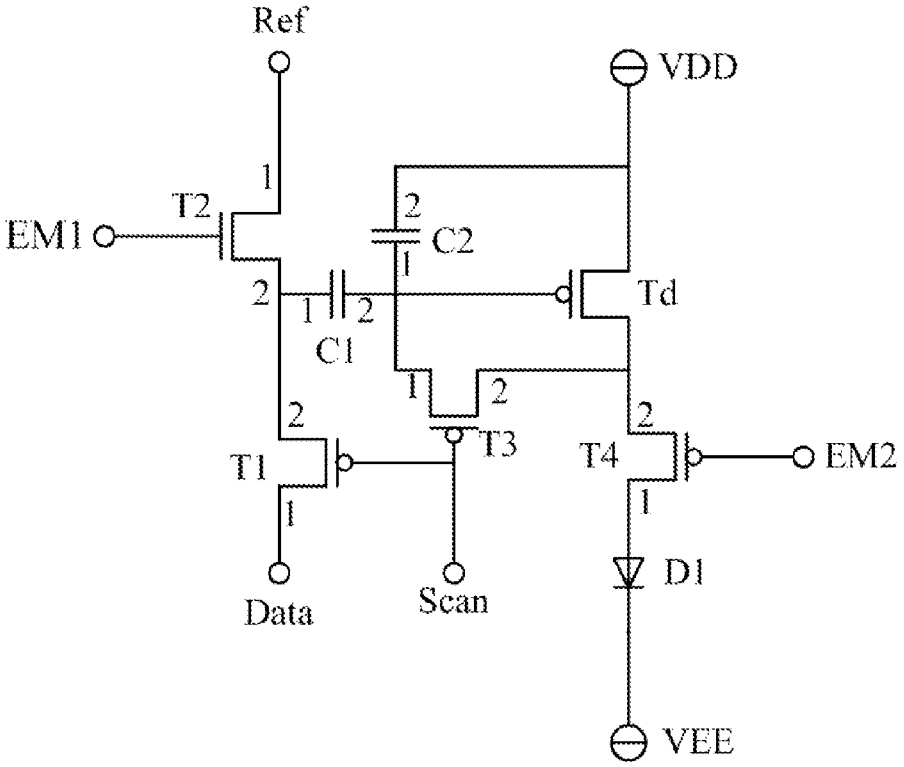
FIG. 4 is another circuit diagram of an organic light emitting diode pixel compensation circuit according to the embodiment of the application.
Figure 6:
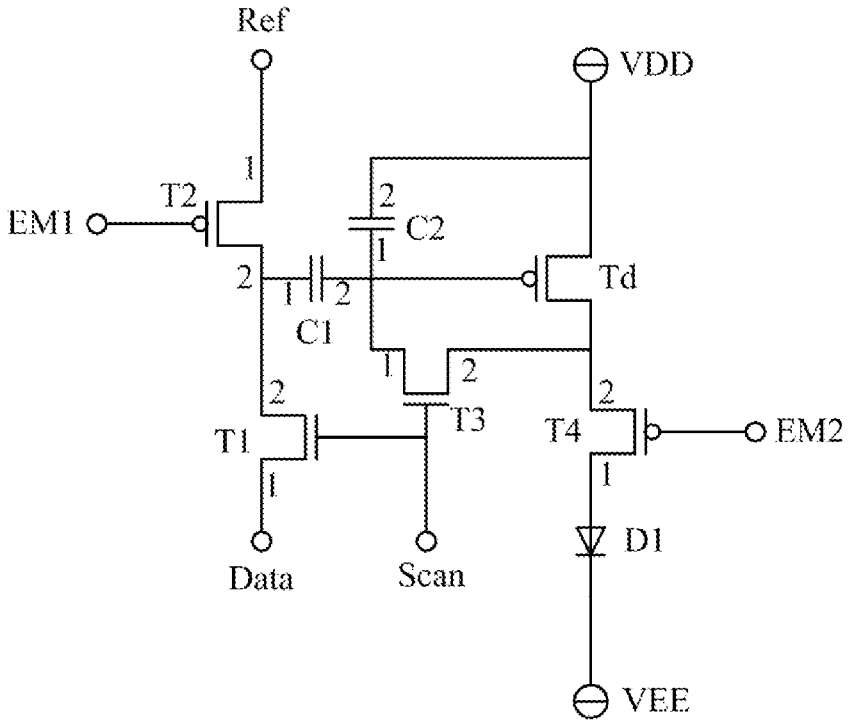
FIG. 6 is another circuit diagram of an organic light emitting diode pixel compensation circuit according to the embodiment of the application.

An organic light emitting diode pixel compensation circuit according to the embodiment of the application as illustrated in FIG. 1, FIG. 4 or FIG. 6 is configured to drive an organic light emitting diode D1 to emit light, where the organic light emitting diode pixel compensation circuit includes a first transistor T1, a second transistor T2, a third transistor T3, a fourth transistor T4, a first capacitor C1, a second capacitor C2 and a drive transistor Td;

The first transistor T1 is configured to transmit a data signal Data to a first pole 1 of the first capacitor C1 based on a scan signal Scan;

The second transistor T2 is configured to transmit a reference signal Ref to the first pole 1 of the first capacitor C1 based on a first light emission signal EM1;

The third transistor T3 is configured to connect a gate of the drive transistor Td with a drain of the drive transistor Td based on the scan signal Scan to read the difference between supply voltage VDD and threshold voltage of the drive transistor Td and to transmit the difference to a second pole 2 of the first capacitor C1 and a first pole 1 of the second capacitor C2;

The fourth transistor T4 is configured to provide the organic light emitting diode D1 with drive current generated by the drive transistor Td based on a second light emission signal EM2;

The first capacitor C1 is configured to store the received voltage and to couple a voltage value based on the change in voltage on the first pole 1 of the first capacitor C1 onto the second pole 2 of the first capacitor C1;

The second capacitor C2 is configured to receive the supply voltage VDD at a second pole 2 of the second capacitor C2; and The drive transistor Td is configured to generate the drive current based on the supply voltage VDD and the voltage on the second pole 2 of the first capacitor C1;

Where the organic light emitting diode D1 is configured to emit light corresponding to the drive current generated by the drive transistor Td.

Optionally as illustrated in FIG. 1, FIG. 4 or FIG. 6, the scan signal Scan is received at the gate of the first transistor T1, and the data signal Data is received at a first pole 1 of the first transistor T1; the first light emission signal EM1 is received at a gate of the second transistor 12, the reference signal Ref is received at a first pole of the second transistor T2, and a second pole 2 of the second transistor 12 is connected respectively with a second pole 2 of the first transistor T1 and the first pole 1 of the first capacitor C1; the second pole 2 of the first capacitor C1 is connected with the gate of the drive transistor Td; the scan signal Scan is received at a gate of the third transistor T3, a first pole 1 of the third transistor T3 is connected with the gate of the drive transistor Td, and a second pole 2 of the third transistor T3 is connected with the drain of the drive transistor Td; the second light emission signal EM2 is received at a gate of the fourth transistor T4, a first pole 1 of the fourth transistor T4 is connected with an anode of the organic light emitting diode D1, and a second pole of the fourth transistor T4 is connected with the drain of the drive transistor Td; a low level signal VEE is received at a cathode of the organic light emitting diode D1; the first pole 1 of the second capacitor C2 is connected with the gate of the drive transistor Td, and the second pole 2 of the second capacitor C2 is connected with a source of the drive transistor Td; and the supply voltage VDD is received at the source of the drive transistor Td.

Particularly all of the first transistor T1, the second transistor T2, the third transistor T3, the fourth transistor T4 and the drive transistor Td in the organic light emitting diode pixel compensation circuit illustrated in FIG. 1 are consisted of PMOS transistors.

All of the first transistor T1, the third transistor T3, the fourth transistor T4 and the drive transistor Td in the organic light emitting diode pixel compensation circuit illustrated in FIG. 4 are consisted of PMOS transistors; and the second transistor T2 is an NMOS transistor.

All of the second transistor T2, the fourth transistor T4 and the drive transistor Td in the organic light emitting diode pixel compensation circuit illustrated in FIG. 6 are consisted of PMOS transistors; and both the first transistor T1 and the third transistor T3 are the consisted of NMOS transistors.

Figure 2:
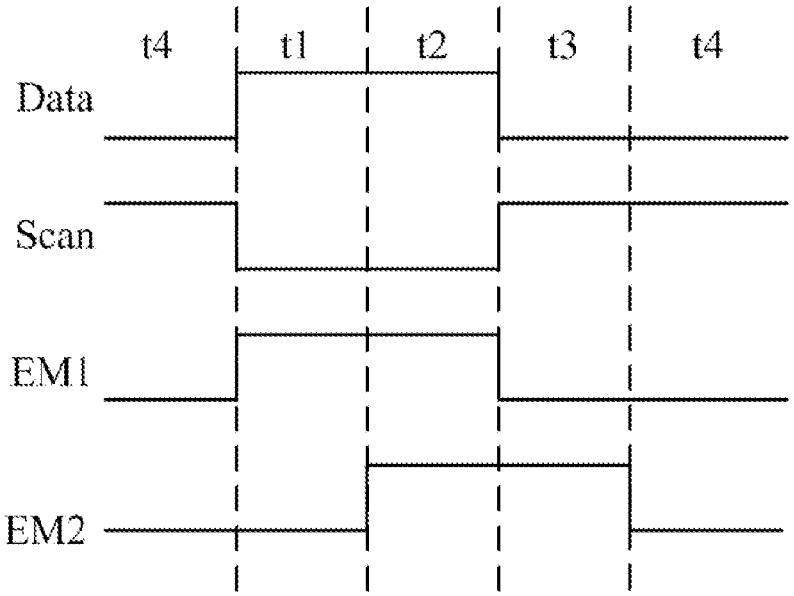
FIG. 2 is a timing diagram of the circuit illustrated in FIG. 1 in operation.

FIG. 2 illustrates an operation timing of the organic light emitting diode pixel compensation circuit illustrated in FIG. 1, where in an initialization phase t1, the first light emission signal EM1 is at a high level, so the second transistor T2 is turned off; the second light emission signal EM2 is at a low level, so the fourth transistor T4 is turned on; and the scan signal Scan is at a low level, so both the first transistor T1 and the third transistor T3 are turned on; that is, the data signal Data will be stored onto the first capacitor C1 through the first transistor T1, that is, the voltage on the first pole 1 of the first capacitor C1 is Vdata, where Vdata is the voltage of the data signal Data; and the low level signal VEE will be received at the gate of the drive transistor Td through the third transistor T3, the fourth transistor T4 and the organic light emitting diode D1, that is, in the initialization phase t1, the gate of the drive transistor Td will be reset to a low level signal Vee, where Vee is the voltage value of the low level signal VEE, thus avoiding influencing data of a display current frame caused by residual data of a displayed previous frame at the gate of the transistor Td.

In a signal load phase t2, the first light emission signal EM1 is at a high level, so the second transistor T2 is turned off; the second light emission signal EM2 is at a high level, so the fourth transistor T4 is turned off; and the scan signal Scan is at a low level, so both the first transistor T1 and the third transistor T3 are turned on. The first transistor T1 is turned on, so the voltage on the first pole 1 of the first capacitor C1 is still Vdata; and the third transistor T3 is turned on, so the drive transistor Td is equivalently viewed as a diode structure in connection, that is, the gate of the drive transistor Td is connected with the drain of the drive transistor Td, so both the voltage at the gate of the drive transistor Td and the voltage at the drain of the drive transistor Td are VDD+Vth when the voltage at the source of the drive transistor Td is the supply voltage VDD, where Vth is threshold voltage of the drive transistor Td, that is, in the signal load phase t2, both the voltage at the second pole 2 of the first capacitor C1 and the voltage at the first pole 1 of the second capacitor C2 are VDD+Vth.

In a drive signal generation phase t3, the first light emission signal EM1 is at a low level, so the second transistor T2 is turned on; the second light emission signal EM2 is at a high level, so the fourth transistor T4 is turned off; and the scan signal Scan is at a high level, so both the first transistor T1 and the third transistor T3 are turned off. The second transistor T2 is turned on, so the reference signal Ref will be stored on the first capacitor C1 through the second transistor T2, that is, the voltage on the first pole 1 of the first capacitor C1 is Vref, where Vref is the voltage of the reference signal Ref that is, the voltage on the first pole 1 of the first capacitor C1 is changed from Vdata in the signal load phase t2 to Vref in the drive signal generation phase t3, so the voltage value based on the change in voltage on the first pole 1 of the first capacitor C1 is Vref−Vdata, while the third transistor T3 is turned off, so the second pole 2 of the first capacitor C1 floats, that is, the voltage on the second pole 2 of the first capacitor C1 will vary with the voltage on the first pole 1 of the first capacitor C1, and both of their changes are equal, so in the drive signal generation phase t3, the voltage on the second pole 2 of the first capacitor C1 is changed to VDD+Vth+Vref−Vdata, that is, the voltage at the gate of the drive transistor Td is VDD+Vth+Vref−Vdata.

In a light emission phase t4, the first light emission signal EM1 is at a low level, so the second transistor T2 is turned on; the second light emission signal EM2 is at a low level, so the fourth transistor T4 is turned on; and the scan signal Scan is at a high level, so both the first transistor T1 and the third transistor T3 are turned off. The fourth transistor T4 is turned on, so the organic light emitting diode D1 can be driven by the current at the drain of the drive transistor Td to emit light. As can be apparent from the equation of a current characteristic of a transistor operating in a saturation region, the current at the drain of the drive transistor Td is iD=(Vg−Vs−Vth)2=(VDD+Vth+Vref−Vdata−VDD−Vth)2=(Vref−Vdata)2, where Vg is the voltage at the gate of the drive transistor Td, and Vs is the voltage at the source of the drive transistor Td.

This indicates the independence of the current at the drain of the drive transistor Td from the threshold voltage Vth of the drive transistor Td and the supply voltage VDD driving the organic light emitting diode D1 to emit light so as to address such a problem that the non-uniformity in the display of the entire image from may occur because different OLEDs are driven by different current upon reception of the same image data signal to emit light as a result of a drift in threshold voltage of the drive transistor Td and of the received supply voltage varying between different pixels due to resistance across a transmission line.

Figure 3:
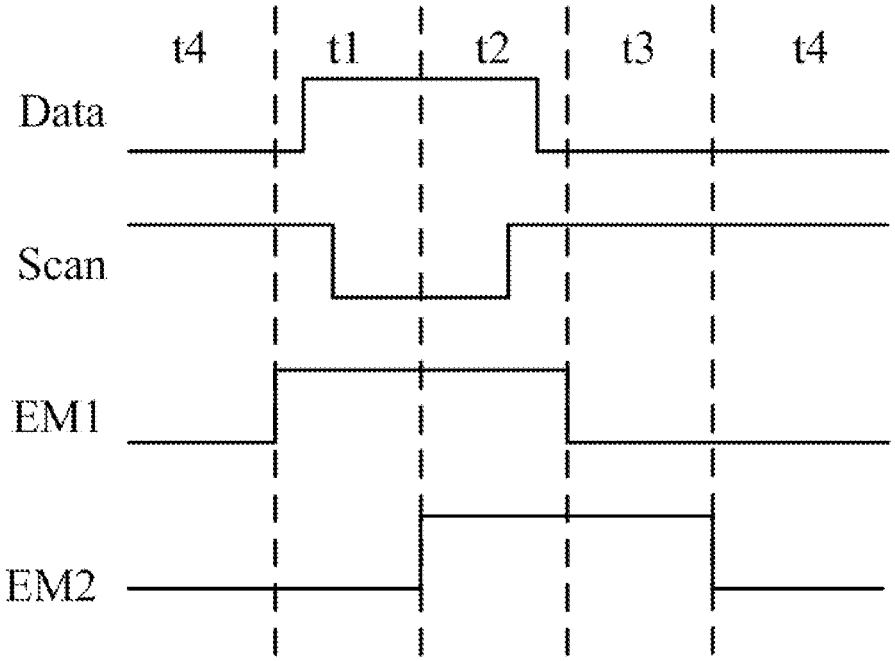
FIG. 3 is another timing diagram of the circuit illustrated in FIG. 1 in operation.

Optionally, FIG. 3 illustrates a timing diagram of the organic light emitting diode pixel compensation circuit illustrated in FIG. 1 in operation. In the timing diagram illustrated in FIG. 3, the scan signal Scan will not jump from a high level to a low level until the first light emission signal EM1 jumps from a low level to a high level, and the scan signal Scan will jump from a low level to a high level before the first light emission signal EM1 jumps from a high level to a low level, thereby making it possible to ensure the second transistor T2 to be turned off while the first transistor T1 is turned on so as to avoid confliction from occurring due to concurrent of the data signal Data and the reference signal Ref at the first pole 1 of the first capacitor C1. It will be sufficient if a period of time it takes for the data signal Data to be changed to a signal to be displayed by the organic light emitting diode D1 in the organic light emitting diode pixel compensation circuit receiving the data signal Data (a period of time for which the data signal Data is at a high level between t1 and t2 in FIG. 3) and a period of time for which the first transistor T1 is turned on (a period of time for which the scan signal Scan is at a low level between t1 and t2 in FIG. 3) overlap for no less than the shortest period of time it takes for the data signal Data to be loaded onto the first pole of the first capacitor C1.

Figure 5:
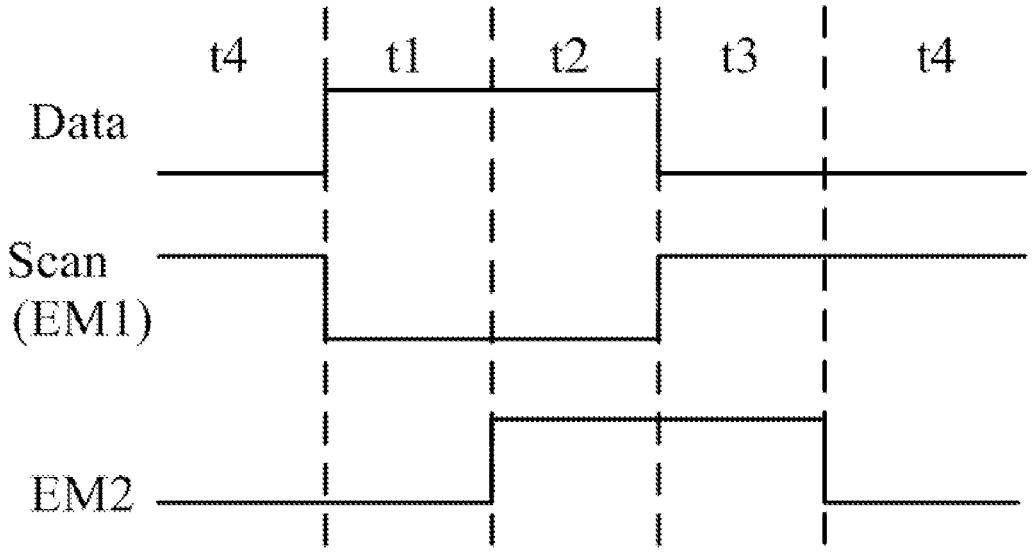
FIG. 5 is a timing diagram of the circuit illustrated in FIG. 4 in operation.

FIG. 5 illustrates a timing diagram of the organic light emitting diode pixel compensation circuit illustrated in FIG. 4 in operation, and in FIG. 4, the second transistor T2 is an NMOS transistor, and both the first transistor T1 and the third transistor 13 are PMOS transistors, and thus as can be apparent from the timing diagram illustrated in FIG. 2 as well, the first light emission signal EM1 and the scan signal Scan can be embodied as signals with the same timing, so FIG. 5 illustrates only a timing diagram of the scan signal Scan but not a timing diagram of the first light emission signal EM1. The organic light emitting diode pixel compensation circuit illustrated in FIG. 4 operates under the same principle as the organic light emitting diode pixel compensation circuit illustrated in FIG. 1 and differs from FIG. 1 only in the transistor type of the second transistor T2 changed without altering the structures and the drive modes of the other circuits and the timing of the other respective drive signals except for the drive voltage or the timing of the first light emission signal EM1, so a repeated description of a particular operation mode thereof will be omitted here, and reference can be made to the foregoing description.

Figure 7:
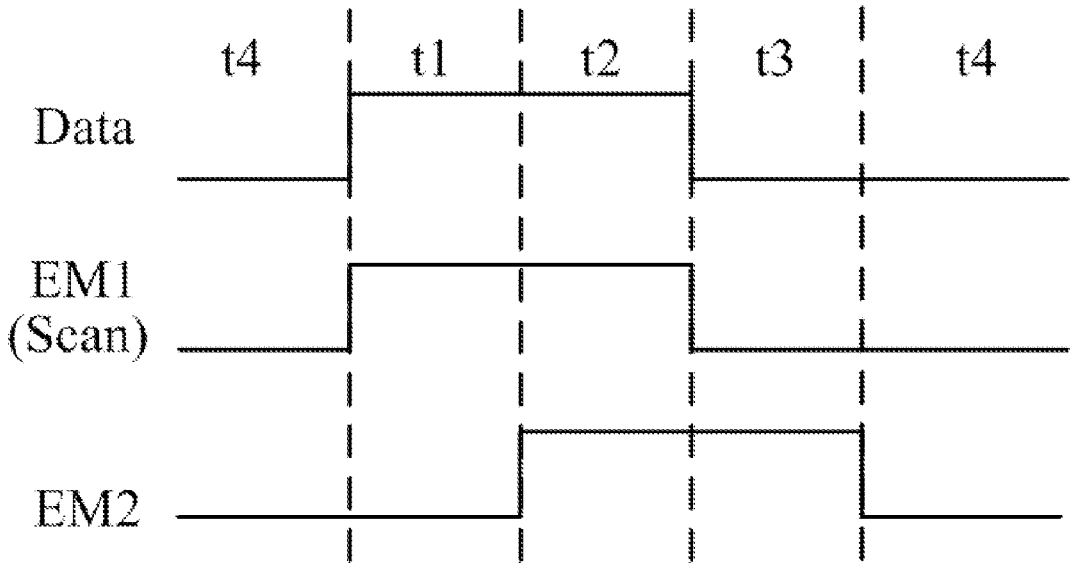
FIG. 7 is a timing diagram of the circuit illustrated in FIG. 6 in operation

FIG. 7 illustrates a timing diagram of the organic light emitting diode pixel compensation circuit illustrated in FIG. 6 in operation, and in FIG. 6, the second transistor T2 is a PMOS transistor, and both the first transistor T1 and the third transistor T3 are NMOS transistors, and thus as can be apparent from the timing diagram illustrated in FIG. 2 as well, the first light emission signal EM1 and the scan signal Scan can be embodied as signals with the same timing, so FIG. 7 illustrates only a timing diagram of the first light emission signal EM1 but not a timing diagram of the scan signal Scan. Alike the organic light emitting diode pixel compensation circuit illustrated in FIG. 6 operates under the same principle as the organic light emitting diode pixel compensation circuit illustrated in FIG. 1 and differs from FIG. 1 only in the transistor type of the first transistor T1 and the transistor T3 changed without altering the structures and the drive modes of the other circuits and the timing of the other respective drive signals except for the timing or the drive voltage of the corresponding scan signal Scan, so a repeated description of a particular operation mode thereof will be omitted here.

Both the first light emission signal EM1 and the second light emission signal EM2 in FIG. 1, FIG. 4 or FIG. 6 are configured to control the transistors to be turned in the light emission phase t4, but the first light emission signal EM1 is configured to control the second transistor T4 to be turned on in both the light emission phase t4 and the drive signal generation phase t3, and the second light emission signal EM2 is configured to control the fourth transistor T4 to be turned in both the light emission phase t4 and the initialization phase t1.

If the second capacitor C2 in the organic light emitting diode pixel compensation circuit illustrated in FIG. 1, FIG. 4 or FIG. 6 is removed, then the sum of the supply voltage VDD and the threshold voltage Vth of the drive transistor Td, i.e., VDD+Vth, can be stored on the second pole 2 of the first capacitor C1 in the signal load phase t2, but the change in voltage on the gate of the third transistor T3, i.e., the change in voltage of the scan signal Scan, will be coupled onto the second pole 2 of the first capacitor C1 due to parasitic capacitance between the gate and the source of the third transistor T3, parasitic capacitance between the gate and the drain of the third transistor T3, and capacitance between overlapping sections of lines, thus resulting in a significant difference between the voltage stored on the second pole 2 of the first capacitor C1 and VDD+Vth, so that the threshold voltage of the drive transistor Td and the supply voltage VDD fail to be compensated for to achieve a preset effect.

With the addition of the second capacitor C2, that is, with the organic light emitting diode pixel compensation circuit illustrated in FIG. 1, FIG. 4 or FIG. 6, the voltage at the second pole 2 of the second capacitor C2, i.e., the potential of the supply voltage VDD, will not vary with time, and the second capacitor C2 is far above the parasitic capacitance of the transistor and the parasitic capacitance across the lines, so the potential at the second pole 2 of the first capacitor C1 can be locked effectively by the second capacitor C2 and thus will not vary significantly with the scan signal Scan any more, so that the voltage stored on the second pole 2 of the first capacitor C1 in the signal load phase t2 can be as close as possible to the sum of the supply voltage VDD and the threshold voltage Vth of the drive transistor Td (i.e., VDD+Vth), to thereby optimize an effect of compensation for the threshold voltage of the drive transistor Td and the supply voltage VDD.

As illustrated FIG. 1, FIG. 4 or FIG. 6, an organic light emitting diode pixel compensation circuit according to another embodiment of the application includes:

A first transistor T1 including a gate to which a scan signal Scan is applied and a first pole 1 to which a data signal Data is applied;

A second transistor T2 including a gate to which a first light emission signal EM1 is applied and a first pole 1 to which a reference signal Ref is applied;

A third transistor T3 including a gate to which the scan signal Scan is applied;

A fourth transistor 14 including a gate to which a second light emission signal EM2 is applied;

A first capacitor C1 including a first pole 1 connected with a second pole 2 of the first transistor T1 and a second pole 2 of the second transistor 12, and a second pole 2 connected with a first pole 1 of the third transistor T3;

A second capacitor C2 including a first pole 1 connected with the first pole 1 of the third transistor T3 and a second pole 2 at which a supply voltage VDD is received;

An organic light emitting diode D1 including a cathode at which a low level signal VEE is received and an anode connected with a first pole 1 of the fourth transistor T4; and A drive transistor Td including a gate connected with the second pole 2 of the first capacitor C1 and the first pole of the second capacitor C2, a source at which the supply voltage VDD is received, and a drain connected with a second pole 2 of the third transistor T3 and a second pole 2 of the fourth transistor T4.

With the organic light emitting diode pixel compensation circuit according to embodiments of the application, the third transistor can be controlled by the scan signal to connect the gate of the drive transistor with the drain of the drive transistor to read the difference between the supply voltage and the threshold voltage of the drive transistor and to store the difference at the second pole of the first capacitor and the first pole of the second capacitor, thereby eliminating an influence of the supply voltage and the threshold voltage of the drive transistor upon generation of drive current by the drive transistor from the supply voltage and the voltage on the second pole of the first capacitor so as to make the generated drive current independent from the supply voltage and the threshold voltage of the drive transistor, which can address such a problem that the non-uniformity in the display of the entire image on the display panel from may occur because OLEDs in different areas are driven by different current upon reception of the same image data signal to emit light as a result of a drift in threshold voltage and of the varying supply voltage received at pixels in the different areas due to resistance across a transmission line of the display panel.

A first pole of a transistor as referred to in the embodiments of the application (the first transistor, the second transistor, the third transistor and the fourth transistor) can be a source (or a drain) of the transistor, and a second pole of the transistor can be the drain (or the source, dependent upon the type of the transistor) of the transistor. If the source of the transistor is the first pole, then the drain of the transistor is the second pole; and if the drain of the transistor is the first pole, then the source of the transistor is the second pole. For a particular operation mode, reference can be made to the foregoing description, and a repeated description thereof will be omitted here.

A display panel according to an embodiment of the application includes the organic light emitting diode pixel compensation circuit according to embodiments of the application. The third transistor in the organic light emitting diode pixel compensation circuit in the display panel can be controlled by the scan signal to connect the gate of the drive transistor with the drain of the drive transistor to read the difference between the supply voltage and the threshold voltage of the drive transistor and to store the difference at the second pole of the first capacitor and the first pole of the second capacitor, thereby eliminating an influence of the supply voltage and the threshold voltage of the drive transistor upon generation of drive current by the drive transistor from the supply voltage and the voltage on the second pole of the first capacitor so as to make the generated drive current independent from the supply voltage and the threshold voltage of the drive transistor, which can address such a problem that the non-uniformity in the display of an image on the display panel from may occur because OLEDs in different areas are driven by different current upon reception of the same image data signal to emit light as a result of a drift in threshold voltage and of the received supply voltage varying due to resistance across a transmission line.

A display device according to an embodiment of the application includes the organic light emitting diode pixel compensation circuit according to embodiments of the application and also possibly the display panel according to the embodiment above of the application. The third transistor in the organic light emitting diode pixel compensation circuit in the display device can be controlled by the scan signal to connect the gate of the drive transistor with the drain of the drive transistor to read the difference between the supply voltage and the threshold voltage of the drive transistor and to store the difference at the second pole of the first capacitor and the first pole of the second capacitor, thereby eliminating an influence of the supply voltage and the threshold voltage of the drive transistor upon generation of drive current by the drive transistor from the supply voltage and the voltage on the second pole of the first capacitor so as to make the generated drive current independent from the supply voltage and the threshold voltage of the drive transistor, which can address such a problem that the non-uniformity in the display of an image on the display device from may occur because OLEDs in different areas are driven by different current upon reception of the same image data signal to emit light as a result of a drift in threshold voltage and of the received supply voltage areas varying due to resistance across a transmission line.

Those skilled in the art can appreciate that the drawings are merely schematic diagrams of preferred embodiments of the application and not all of the modules or flows in the drawings are necessarily necessary for the application to be put into practice.

Those skilled in the art can appreciate that the modules in the devices according to the embodiments can be distributed in the devices of the embodiments as described in the embodiments or located in one or more other devices than the embodiments in question while being adapted correspondingly. The modules in the foregoing embodiments can be integrated into a module or further split into a plurality of sub-modules.

The foregoing embodiments of the application have been numbered merely for the convenience of their description but will not indicate any precedence of one embodiment over the other.

Evidently those skilled in the art can make various modifications and variations to the application without departing from the spirit and scope of the application. Thus the application is also intended to encompass these modifications and variations thereto so long as the modifications and variations come into the scope of the claims appended to the application and their equivalents.

What is claimed is:

1. An organic light emitting diode pixel compensation circuit configured to drive an organic light emitting diode to emit light, wherein the organic light emitting diode pixel compensation circuit comprises:

a first transistor, a second transistor, a third transistor, a fourth transistor, a first capacitor, a second capacitor, and a drive transistor, wherein when the third transistor and the fourth transistor are both turned on, the gate of the drive transistor is reset, wherein:

the first transistor is configured to transmit a data signal to a first pole of the first capacitor based on a scan signal, the second transistor is configured to transmit a reference signal to the first pole of the first capacitor based on a first light emission signal, the third transistor is configured to connect a gate of the drive transistor with a drain of the drive transistor based on the scan signal to read the difference between supply voltage and threshold voltage of the drive transistor and to transmit the difference to a second pole of the first capacitor and to a first pole of the second capacitor, the fourth transistor is configured to provide the organic light emitting diode with drive current generated by the drive transistor based on a second light emission signal, the first capacitor is configured to store the received voltage and to couple a voltage value based on the change in voltage on the first pole of the first capacitor onto the second pole of the first capacitor, the second capacitor is configured to receive the supply voltage at a second pole of the second capacitor, the drive transistor is configured to generate the drive current based on the supply voltage and the voltage on the second pole of the first capacitor, and the organic light emitting diode is configured to emit light corresponding to the drive current generated by the drive transistor.

2. The circuit of claim 1, wherein:

the scan signal is received at the gate of the first transistor;

the data signal is received at a first pole of the first transistor;

the first light emission signal is received at a gate of the second transistor;

the reference signal is received at a first pole of the second transistor;

a second pole of the second transistor is connected respectively with a second pole of the first transistor and the first pole of the first capacitor;

the second pole of the first capacitor is connected with a gate of the drive transistor;

the scan signal is received at a gate of the third transistor;

a first pole of the third transistor is connected with the gate of the drive transistor;

a second pole of the third transistor is connected with a drain of the drive transistor;

the second light emission signal is received at a gate of the fourth transistor;

a first pole of the fourth transistor is connected with an anode of the organic light emitting diode;

a second pole of the fourth transistor is connected with the drain of the drive transistor;

a low level signal is received at a cathode of the organic light emitting diode;

the first pole of the second capacitor is connected with the gate of the drive transistor;

the second pole of the second capacitor is connected with a source of the drive transistor; and the supply voltage is received at the source of the drive transistor.

3. The circuit of claim 2, wherein the third transistor is further configured to transmit the voltage at the second pole of the fourth transistor to the second pole of the first capacitor and to the first pole of the second capacitor based on the scan signal.

4. The circuit of claim 2, wherein the fourth transistor is further configured to transmit the low level signal received by the organic light emitting diode to the second pole of the fourth transistor based on the second light emission signal.

5. The circuit of claim 2, wherein the first transistor is a PMOS transistor, and the second transistor is a PMOS transistor.

6. The circuit of claim 2, wherein:

the first transistor is a PMOS transistor, and the second transistor is an NMOS transistor; or the first transistor is an NMOS transistor, and the second transistor is a PMOS transistor; and the first light emission signal is the same as the scan signal.

7. The circuit of claim 2, wherein the third and fourth transistors and the drive transistors are PMOS transistors.

8. An organic light emitting diode pixel compensation circuit, comprising:

a first transistor comprising:

a gate to which a scan signal is applied, and a first pole to which a data signal is applied;

a second transistor comprising:

a gate to which a first light emission signal is applied, and a first pole to which a reference signal is applied;

a third transistor comprising a gate to which the scan signal is applied;

a fourth transistor comprising a gate to which a second light emission signal is applied;

a first capacitor comprising;

a first pole connected with a second pole of the first transistor and a second pole of the second transistor, and a second pole connected with a first pole of the third transistor;

a second capacitor comprising:

a first pole connected with the first pole of the third transistor, and a second pole at which a supply voltage is received;

an organic light emitting diode comprising:

a cathode at which a low level signal is received, and an anode connected with a first pole of the fourth transistor; and a drive transistor comprising:

a gate connected with the second pole of the first capacitor and with the first pole of the second capacitor, a source to which the supply voltage is applied, and a drain connected with a second pole of the third transistor and a second pole of the fourth transistor;

wherein when the third transistor and the fourth transistor are both turned on, the gate of the drive transistor is reset.

9. A display panel, comprising an organic light emitting diode pixel compensation circuit, wherein the organic light emitting diode pixel compensation circuit comprises:

a first transistor comprising:

a gate to which a scan signal is applied, and a first pole to which a data signal is applied;

a second transistor comprising:

a gate to which a first light emission signal is applied, and a first pole to which a reference signal is applied;

a third transistor comprising a gate to which the scan signal is applied;

a fourth transistor comprising a gate to which a second light emission signal is applied;

a first capacitor comprising;

a first pole connected with a second pole of the first transistor and a second pole of the second transistor, and a second pole connected with a first pole of the third transistor;

a second capacitor comprising:
a first pole connected with the first pole of the third transistor, and
a second pole at which a supply voltage is received;
an organic light emitting diode comprising:
a cathode at which a low level signal is received, and
an anode connected with a first pole of the fourth transistor; and
a drive transistor comprising:
a gate connected with the second pole of the first capacitor and with the first pole of the second capacitor,
a source to which the supply voltage is applied, and
a drain connected with a second pole of the third transistor and a second pole of the fourth transistor,
wherein when the third transistor and the fourth transistor are both turned on, the gate of the drive transistor is reset, or
the organic light emitting diode pixel compensation circuit drives an organic light emitting diode to emit light, and the organic light emitting diode pixel compensation circuit comprises:
a first transistor,
a second transistor,
a third transistor,
a fourth transistor,
a first capacitor,
a second capacitor, and
a drive transistor, wherein:
the first transistor is configured to transmit a data signal to a first pole of the first capacitor based on a scan signal,
the second transistor is configured to transmit a reference signal to the first pole of the first capacitor based on a first light emission signal,
the third transistor is configured to connect a gate of the drive transistor with a drain of the drive transistor based on the scan signal to read the difference between supply voltage and threshold voltage of the drive transistor and to transmit the difference to a second pole of the first capacitor and to a first pole of the second capacitor,
the fourth transistor is configured to provide the organic light emitting diode with drive current generated by the drive transistor based on a second light emission signal,
the first capacitor is configured to store the received voltage and to couple a voltage value based on the change in voltage on the first pole of the first capacitor onto the second pole of the first capacitor,
the second capacitor is configured to receive the supply voltage at a second pole of the second capacitor,
the drive transistor is configured to generate the drive current based on the supply voltage and the voltage on the second pole of the first capacitor, and
the organic light emitting diode is configured to emit light corresponding to the drive current generated by the drive transistor;
wherein when the third transistor and the fourth transistor are both turned on, the gate of the drive transistor is reset.

10. A display device, comprising an organic light emitting diode pixel compensation circuit, wherein the organic light emitting diode pixel compensation circuit comprises:
a first transistor comprising:
a gate to which a scan signal is applied, and
a first pole to which a data signal is applied;
a second transistor comprising:
a gate to which a first light emission signal is applied, and
a first pole to which a reference signal is applied;
a third transistor comprising a gate to which the scan signal is applied;
a fourth transistor comprising a gate to which a second light emission signal is applied;
a first capacitor comprising;
a first pole connected with a second pole of the first transistor and a second pole of the second transistor, and
a second pole connected with a first pole of the third transistor;
a second capacitor comprising:
a first pole connected with the first pole of the third transistor, and
a second pole at which a supply voltage is received;
an organic light emitting diode comprising:
a cathode at which a low level signal is received, and
an anode connected with a first pole of the fourth transistor; and
a drive transistor comprising:
a gate connected with the second pole of the first capacitor and with the first pole of the second capacitor,
a source to which the supply voltage is applied, and
a drain connected with a second pole of the third transistor and a second pole of the fourth transistor,
wherein when the third transistor and the fourth transistor are both turned on, the gate of the drive transistor is reset; or
the organic light emitting diode pixel compensation circuit drives an organic light emitting diode to emit light, and the organic light emitting diode pixel compensation circuit comprises:
a first transistor,
a second transistor,
a third transistor,
a fourth transistor,
a first capacitor,
a second capacitor, and
a drive transistor, wherein:
the first transistor is configured to transmit a data signal to a first pole of the first capacitor based on a scan signal,
the second transistor is configured to transmit a reference signal to the first pole of the first capacitor based on a first light emission signal,
the third transistor is configured to connect a gate of the drive transistor with a drain of the drive transistor based on the scan signal to read the difference between supply voltage and threshold voltage of the drive transistor and to transmit the difference to a second pole of the first capacitor and to a first pole of the second capacitor,
the fourth transistor is configured to provide the organic light emitting diode with drive current generated by the drive transistor based on a second light emission signal,
the first capacitor is configured to store the received voltage and to couple a voltage value based on the change in voltage on the first pole of the first capacitor onto the second pole of the first capacitor,
the second capacitor is configured to receive the supply voltage at a second pole of the second capacitor, the drive transistor is configured to generate the drive current based on the supply voltage and the voltage on the second pole of the first capacitor, and the organic light emitting diode is configured to emit light corresponding to the drive current generated by the drive transistor;

wherein when the third transistor and the fourth transistor are both turned on, the gate of the drive transistor is reset.

* * * * *